US009132309B2

(12) United States Patent
Bowers

(10) Patent No.: US 9,132,309 B2
(45) Date of Patent: Sep. 15, 2015

(54) EXERCISE APPARATUS AND METHOD OF USE THEREOF

(71) Applicant: Brandon Bowers, Phoenix, AZ (US)

(72) Inventor: Brandon Bowers, Phoenix, AZ (US)

( * ) Notice: Subject to any disclaimer, the term of this patent is extended or adjusted under 35 U.S.C. 154(b) by 192 days.

(21) Appl. No.: 13/632,822

(22) Filed: Oct. 1, 2012

(65) Prior Publication Data

US 2013/0085040 A1 Apr. 4, 2013

Related U.S. Application Data

(60) Provisional application No. 61/542,002, filed on Sep. 30, 2011.

(51) Int. Cl.

| | |
|---|---|
| ***A63B 21/055*** | (2006.01) |
| ***A63B 21/065*** | (2006.01) |
| ***A63B 21/00*** | (2006.01) |
| ***A63B 23/035*** | (2006.01) |
| ***A63B 21/06*** | (2006.01) |

(52) U.S. Cl.

CPC ..... *A63B 21/0552* (2013.01); *A63B 21/0557* (2013.01); *A63B 21/065* (2013.01); *A63B 21/1415* (2013.01); *A63B 21/1419* (2013.01); *A63B 21/1423* (2013.01); *A63B 21/1434* (2013.01); *A63B 21/1449* (2013.01); *A63B 21/1484* (2013.01); *A63B 23/03541* (2013.01); *A63B 23/03575* (2013.01); *A63B 21/0602* (2013.01); *A63B 21/0603* (2013.01); *A63B 2207/02* (2013.01); *A63B 2213/00* (2013.01); *A63B 2220/17* (2013.01); *A63B 2225/682* (2013.01); *A63B 2230/06* (2013.01); *A63B 2230/30* (2013.01)

(58) Field of Classification Search

CPC ..... A63B 21/065; A63B 21/1434; A63B 21/1449; A63B 21/0557; A63B 21/0552; A63B 21/055; A63B 21/1403; A63B 21/0407; A41D 13/0012; A41D 2600/10; Y10T 24/1397; Y10T 24/47; Y10T 24/316; Y10T 24/314; Y10T 24/318; Y10T 24/31; Y10T 24/13

USPC ..... 482/51, 74, 93, 121–122, 124–125, 482/139; 2/247, 249–250; 24/3.13, 265 R, 24/300, 301, 529, 658, 666, 667, 669, 672

See application file for complete search history.

(56) References Cited

U.S. PATENT DOCUMENTS

| | | | | |
|---|---|---|---|---|
| 3,759,510 | A * | 9/1973 | Jackson, Jr. | 482/105 |
| 4,308,647 | A * | 1/1982 | Gillis | 24/460 |

(Continued)

*Primary Examiner* — Loan H Thanh
*Assistant Examiner* — Jennifer M Deichl
(74) *Attorney, Agent, or Firm* — Schmeiser, Olsen & Watts LLP

(57) ABSTRACT

An exercise apparatus is provided. The exercise apparatus includes upper-body and lower-body sections, the sections being made of a stretchable material that form fits around the wearer. Each of the sections is configured to have coupled thereto a weight, or a plurality of weights, as selected by the wearer. The weights can be positioned and attached to the apparatus at any location on the apparatus as chosen by the user, such that the position and size of the weights is customizable by the individual wearer. Also, the exercise apparatus includes ports for receiving elastic members, the ports being coupled to the apparatus at predetermined locations on the apparatus. The ports allow the wearer to releasably couple an elastic member between any two ports chosen by the wearer, such that the elastic member provides elastic resistance to the wearer as the wearer moves his/her joints in the apparatus.

4 Claims, 10 Drawing Sheets

(56) References Cited

U.S. PATENT DOCUMENTS

| | | | | |
|---|---|---|---|---|
| 4,382,302 | A * | 5/1983 | Watson | 2/102 |
| 5,176,600 | A * | 1/1993 | Wilkinson | 482/124 |
| 5,607,378 | A * | 3/1997 | Winston | 482/105 |
| 5,937,441 | A * | 8/1999 | Raines | 2/69 |
| 2006/0046913 | A1 * | 3/2006 | Squittieri | 482/124 |
| 2011/0209264 | A1 * | 9/2011 | Williams et al. | 2/69 |
| 2013/0000021 | A1 * | 1/2013 | Dolcetti | 2/455 |

* cited by examiner

EXERCISE APPARATUS AND METHOD OF USE THEREOF

CROSS REFERENCE TO RELATED APPLICATION[S]

This application claims priority to U.S. Provisional Patent Application to Bowers entitled "EXERCISE APPARATUS AND METHOD OF USE THEREOF," Ser. No. 61/542,002, filed Sep. 30, 2011, the disclosure of which is hereby incorporated entirely herein by reference.

BACKGROUND

1. Technical Field

This disclosure relates generally to exercise equipment, and in particular to an exercise apparatus that can be worn by an individual user to exercise.

2. State of the Art

Exercise has long been touted as a means for keeping oneself not only physically fit but mentally and emotionally fit as well. Exercise is a broad term that encompasses such activities as recreational sports, running, cross-training, weightlifting, dance, yoga, and martial arts, just to name a few. However, just because exercise comes in a variety of forms that are widely available does not mean that exercise is commonly undertaken.

There are many reasons why exercise is not a more commonplace activity in our everyday lives. One reason might be the amount of effort required to not only get started but the additional effort required to maintain an exercising routine. To get started with an exercise routine, it often requires the appropriate clothing, gear, or equipment. For some, a gym membership that provides the membership holder access to the latest and greatest equipment is the only way to exercise. However, many do not have access to a gym or wish to pay the membership fees. Not to mention, even after a membership is purchased, the effort it takes to get to the gym many times precludes membership holders from actually using the membership. In addition, many believe that, without the proper gear, the effort they put into exercising will not produce the desired result. As a result, they simply do not start.

Another reason why exercise is not a more commonplace activity is that exercising takes time. It takes time to plan our exercise routine, prepare to exercise, and then actually exercise. This time requirement regularly conflicts with our general lack of spare time. In fact, it is the absence of time that often precludes us from having the opportunity to exercise. For example, the demands of a career often consume the extra hours in our day that we might otherwise be able to dedicate to exercising. Likewise, responsibilities to our families, friends, and social contacts consume our available spare time that we might be able to dedicate to exercising. Indeed, the demands on our time are plentiful and they routinely take precedence over and extinguish the time needed to exercise.

Another reason why exercise is not a more commonplace activity is that many persons simply do not know how to exercise. Without knowing how to exercise, a person will likely never start. And, even if they do start, exercising without knowing how to do so will likely result in limited results, which will discourage those persons from sustained exercise.

In view of the above, there is a need in the physical fitness industry for an exercise apparatus that deals with the problems described above. The exercise apparatus described herein addresses these problems.

SUMMARY

The present disclosure relates to exercise equipment, and in particular to an exercise apparatus that can be used by an individual who wishes to exercise by going about the individual's everyday activities.

An aspect of the present disclosure includes an exercise apparatus comprising an upper-body section and a lower-body section, the sections being made of a stretchable material that form fits around the wearer. Each of the sections is configured to have coupled thereto a weight, or a plurality of weights, as selected by the wearer of the apparatus. The weights can be positioned and attached to the apparatus at any location on the apparatus as chosen by the user.

Another aspect of the present disclosure includes ports for receiving elastic members, the ports being coupled to the apparatus at predetermined locations on the apparatus. The ports allow the wearer to releasably couple an elastic member between any two ports chosen by the wearer, such that the elastic member provides elastic resistance to the wearer as the wearer moves his/her joints in the apparatus.

Another aspect of the present disclosure includes the user wearing the apparatus described above while performing the everyday activities that the user would typically perform. In this way, the user goes about accomplishing the everyday routine, but yet at the same time exercises by wearing the apparatus. Although somewhat cliché, wearing the apparatus is almost like killing two birds with one stone. The user exercises at the same time as accomplishing the user's normal everyday routine.

Another aspect of the present disclosure includes the exercise apparatus comprising: an upper-body portion comprised of stretch material and configured to be secured about a upper body of the user, the upper-body portion having a neck opening configured to receive a neck of the user therethrough and a pair of sleeves configured to receive therethrough respective upper limbs of the user; a lower-body portion comprised of stretch material and configured to be secured about a lower body of the user, the lower-body portion being configured to receive legs of the user therethrough; and a weight, wherein the weight is configured to releasably couple directly to the stretch material of one of the upper-body portion and the lower-body portion as determined by the user.

Another aspect of the present disclosure includes wherein the stretch material of the upper-body portion comprises a first region and a second region, wherein the first region is a material that exhibits wicking properties and the second region is a material configured with a surface that is configured to receive and retain thereon the weight.

Another aspect of the present disclosure includes wherein the first region is comprised of bamboo fabric that exhibits wicking properties and the second fabric is comprised of neoprene having a surface for coupling the weight thereto.

Another aspect of the present disclosure includes wherein the stretch material of the lower-body portion comprises a first region and a second region, wherein the first region is a material that exhibits wicking properties and the second region is a material that is configured to receive and retain thereon the weight.

Another aspect of the present disclosure includes wherein the first region is comprised of bamboo fabric that exhibits wicking properties and the second fabric is comprised of neoprene having a surface for coupling the weight thereto.

Another aspect of the present disclosure includes wherein the sleeves are configured to extend along the upper limbs to wrists of the user.

Another aspect of the present disclosure includes wherein a forearm portion of the sleeve is configured to decouple from the upper-body portion at or near a user's elbow.

Another aspect of the present disclosure includes wherein the lower-body portion is configured to extend along the legs to ankles of the user.

Another aspect of the present disclosure includes wherein a shin portion of the lower-body portion is configured to decouple from the lower-body portion at or near a user's knee.

Another aspect of the present disclosure includes wherein the stretch material is configured to conform to a physique of the user as the user moves to maintain the weight functionally against the user's physique.

Another aspect of the present disclosure includes the weight further comprising: a flexible substrate having a front surface; a weighted part functionally coupled to the front surface of the substrate; and a coupling surface configured to oppose the front surface, the coupling surface being configured to functionally adhere the weighted part to the apparatus.

Another aspect of the present disclosure includes wherein a plurality of weighted parts are configured side-by-side in a row and column configuration, wherein neighboring weighted parts define a void therebetween for allowing the weighted parts to move with respect to one another and together with the substrate as the substrate flexes in response to the user's movements.

Another aspect of the present disclosure includes wherein the weight further comprises an interior covering that covers the weighted parts and is functionally coupled to the substrate between each weighted part.

Another aspect of the present disclosure includes wherein the apparatus comprises a monitoring system thereon that is configured to monitor at least one of a user's heart rate, a user's footsteps, and a user's blood pressure.

Another aspect of the present disclosure includes the apparatus further comprising: a port positioned in the apparatus at or near a joint of the user; and an elastic member configured to functionally engage the port.

Another aspect of the present disclosure includes the port further comprising: an interior base portion; and an exterior base portion, the exterior base portion and the interior base portion being configured to couple to one another with the stretch material positioned therebetween.

Another aspect of the present disclosure includes the exterior base further comprising: a socket configured to receive the elastic member; a tab within the socket, the tab being biased toward the socket and configured to push against the elastic member under the condition that the socket engages the elastic member; and a lip on the tab, the lip being configured to retain the elastic member within the socket under the condition that the socket engages the elastic member.

Another aspect of the present disclosure includes the elastic member further comprising: an elastic band; a coupling configured to functionally engage the elastic band; a cap having a central bore and a first and second opening opposing one another, wherein the elastic band is configured to extend from the first opening and the central bore of the cap is configured to engage and retain therein the elastic band having the coupling engaged therewith; and a tip, the second opening of the cap configured to functionally engage the tip, wherein under the condition that the elastic member is functionally coupled to the port, the tip functionally engages the socket and is retained therein.

Another aspect of the present disclosure includes wherein the tip has a rounded shape and the tip and the socket function as a ball and socket joint.

Another aspect of the present disclosure includes wherein the elastic member comprises opposing ends, one of the opposing ends being configured to functionally engage a port on the apparatus and the other of the opposing ends being configured to functionally engage another port at a different position on the apparatus.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS OF THE DISCLOSURE

As discussed above, embodiments of the present disclosure relate to exercise equipment, and in particular to an exercise apparatus that can be used by an individual who wishes to exercise by going about the individual's everyday activities.

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figures 1, 2, 3:
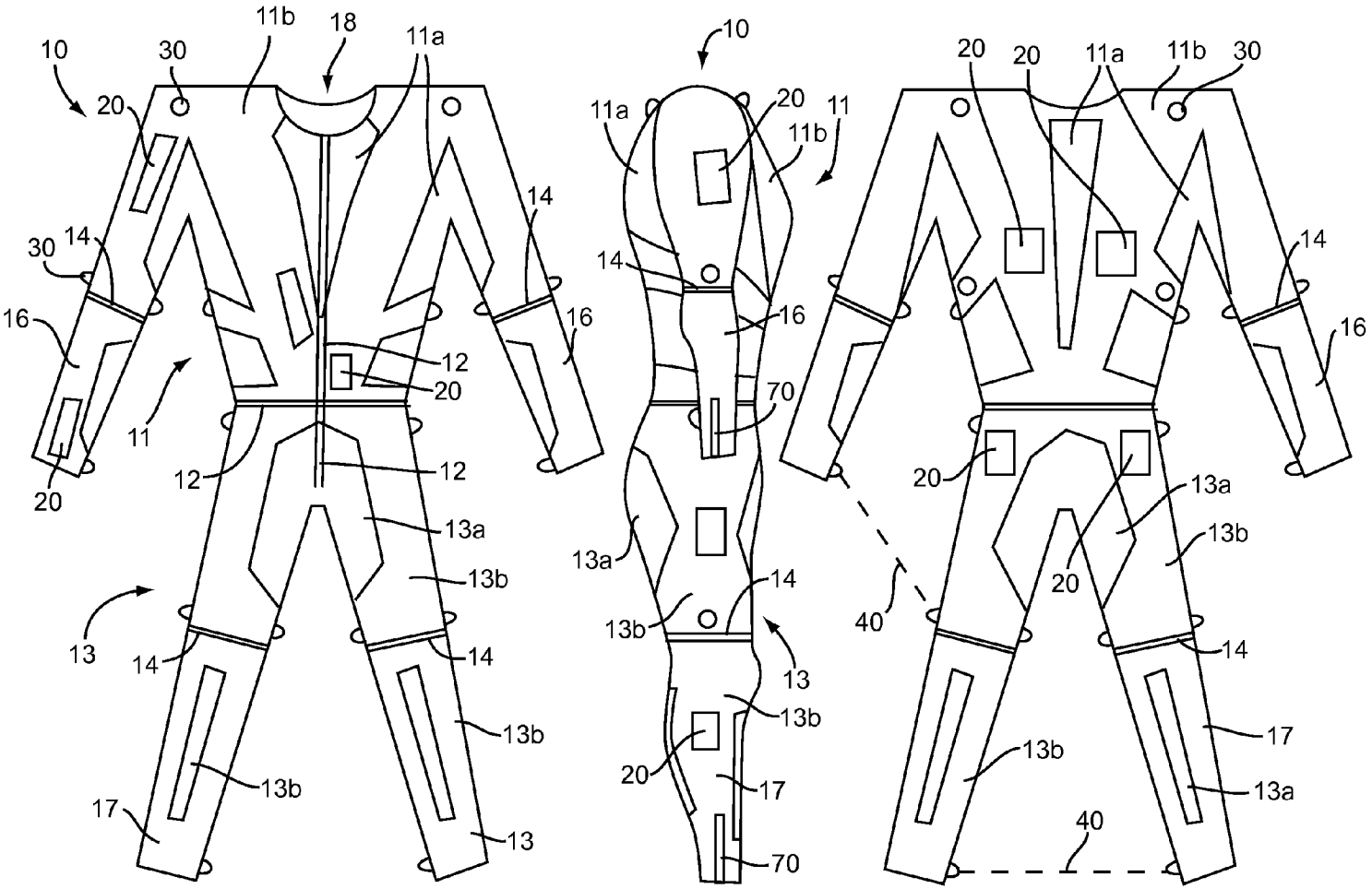
FIG. 1 is a front view of an exercise apparatus in accordance with the present disclosure.
FIG. 2 is a side view of the exercise apparatus in accordance with the present disclosure.
FIG. 3 is a rear view of the exercise apparatus in accordance with the present disclosure.

As shown in FIGS. 1-3, embodiments of an exercise or wellness apparatus 10 may be comprised of an article of clothing that may be worn by a user, the apparatus 10 comprising a torso or upper-body portion 11 and a leg or lower-body portion 13 that can be worn by a user. The upper-body portion 11 has openings therein for the user to place his/her upper appendages, or arms, therethrough. The lower-body portion 13 has openings therein for the user to place his/her lower appendages, or legs, therethrough. The portions 11 and 13 may be comprised of one or more types of materials. For example, the apparatus 10 may be comprised of stretch material. The stretch material may aid in the blood circulation of the user, as in the application of treating blood clots wherein consistent pressure is applied to the user's body by the apparatus 10. The apparatus 10 may be comprised of a wicking portion 11*a*/13*a* that may be a material having breathable and/or stretchable properties. In some embodiments, the wicking portion 11*a*/13*a* may have some anti-microbial properties. The wicking portion 11*a*/13*a* may be comprised of, for example, but not limited thereto, bamboo fabric that is light and strong, has excellent wicking properties, and is to some extent antibacterial. On the other hand, the apparatus 10 may be comprised of an attachment portion 11*b*/13*b* that may be a material having coupling and/or binding properties. The attachment portion 11*b*/13*b* may be comprised of, for example, but not limited thereto, a neoprene material having small loops thereon that are capable of being hooked by a corresponding hook, as will be described below.

Embodiments of the apparatus 10 may further comprise the wicking portions 11*a*/13*a* and the attachment portions 11*b*/13*b* each having properties that allow the respective material to hug the contour of the individual user, once the portions 11*a*/11*b* and 13*a*/13*b* are placed onto the user. Moreover, the wicking portions 11*a*/13*a* may be configured in the apparatus 10 at locations where the user may perspire more so than other locations, such as, for example, under the arms and between the legs. However, it should be understood that the wicking portions 11*a*/13*a* may be configured in the apparatus 10 as desired during design and manufacture. Embodiments of the apparatus 10 further comprise the apparatus being comprised completely of material that comprises the attachment portion 11*b*/13*b*, such that the entire apparatus 10 is comprised of a flexible, breathable material, such as neoprene, the material having a surface configured with small loops thereon that are capable of being hooked by a corresponding hook, as will be described below.

Embodiments of the apparatus 10 further comprise the upper-body portion 11 being configured to be releasably coupled by way of a fastener 12 to the lower-body portion 13, and vice versa, if desired. Alternatively, the apparatus 10 can be configured to be a single piece that incorporates the upper-body portion 11 and lower-body portion 13 in a single unitary article of clothing. The user may then place his/her legs in the lower-body portion 13 of the apparatus 10 and then pull the upper body portion 11 of the single-piece apparatus 10 up and over the user's shoulders. The user can then secure the single-piece apparatus 10 around the user by way of operating a fastener 12.

The upper-body portion 11 can be worn by the user by unfastening the main fastener 12, such that the user can slide his/her arms into the sleeves of the upper-body portion 11 and place the portion 11 up and over the user's shoulders, much in the same way a user places a conventional zippered-jacket over oneself. Also, the portion 11 further comprises a neck opening 18, wherein when the user places the portion 11 on the user's body, the user's neck extends out of the neck opening 18. Once placed over the user, the portion 11 is then fastened around the user by operating the fastener 12 to fasten the fastener 12 to itself to close the front of the portion 11 around the front torso of the user. In the embodiment shown in FIG. 1, the fastener 12 is a zipper, but the fastener 12 can be any fastening device now known or later developed that allows a user to unfasten the upper-body portion 11, place the opened portion 11 on the user's body, and fasten/tighten the portion 11 around the user's upper body by fastening the fastener 12.

As shown in FIGS. 1-3, embodiments of the apparatus 10 further comprise the upper-body portion 11 and/or the lower-body portion 13 having secondary fasteners 14. The secondary fasteners 14 may facilitate the removal of a forearm section 16 from the remaining upper-body portion 11. Likewise, secondary fasteners 14 may facilitate the removal of a shin section 17 at or proximate the user's knee on each leg of the lower-body portion 13. Once unfastened, the forearm section 16 can be removed from the user's arm without removing the remaining portions of the upper-body portion 11. Likewise, the shin section 17 can be removed from the user's leg without removing the remaining portions of the lower-body portion 13. Thereafter, the user may continue to wear and utilize the upper-body portion 11 or the lower-body portion 13, without the forearm section 16 or the shin section 17, respectively. Without the sleeve sections 16, the portion 11 becomes a short-sleeved garment, whereas with the sleeve sections 16 attached the portion 11 functions as a long-sleeved garment. Without the shin sections 17, the portion 13 becomes shorts, whereas with the shin sections 17 attached the portion 13 functions as pants. Accordingly, if desired, the user may reattach the forearm section 16 or the shin section 17 by operating the respective secondary fastener 14 to refasten the forearm section 16 to the portion 11 or the shin section 17 to the portion 13, respectively. The secondary fasteners 14 may be placed on the sleeve portions of the upper-body portion 11 to allow the user to remove the corresponding sleeve sections 16 from the upper-body portion 11. However, the secondary fasteners 14 can be placed at any location on the upper-body portion 11 that facilitates removal of a certain section of the upper-body portion 11 while leaving the remaining part of the portion 11 on/around the user. Likewise, the secondary fasteners 14 can be placed at any location on the lower-body portion 13 that facilitates removal of a certain section of the lower-body portion 13 while leaving the remaining part of the portion 13 on/around the user. Thus, multiple secondary fasteners 14 may be incorporated into the design of the apparatus 10, such that the secondary fasteners 14 allow removal of various pre-determined sections from the overall apparatus 10 while the user continues to wear the remaining overall apparatus 10.

As shown in FIGS. 1-3, embodiments of the apparatus 10 may further comprise expansion slots 70 in the end of the arm sleeve or in the end of the leg section, the expansion slot 70 being configured to assist the user in wearing the apparatus, or in particular in putting the apparatus 10 on oneself or removing the apparatus 10 from oneself. The expansion slots 70 may be configured to expand or contract. For example, the expansion slots 70 may be configured with a zipper, such that under the condition that the zipper is undone, the material of the upper-body portion 11 or the lower-body portion 13 surrounding the expansion slots 70 may move away from itself to thus create a wider area in which the user may insert an arm or leg, respectively. The expansion slots 70 may further comprise stretchy material that is configured to substantially stretch to allow the expansion slot 70 to expand as a hand or foot passes therethough and then to restrict after the hand or foot has passed therethrough.

As shown in FIGS. 4-10, embodiments of the apparatus 10 may further comprise weights 20. The weight 20 may have a thin profile, such that the weight does not overly protrude from the user or the apparatus 10 once attached thereto. Each weight 20 may be configured to be repeatedly and releasably coupled to the apparatus 10, as frequently as desired by the user. Specifically, the user may customize the number of and weight allocation of the weights 20 over the apparatus 10 by attaching each weight 20 in a user-determined location on the apparatus 10. As shown in FIGS. 1-3, the weights 20 may be attached to the apparatus 10 by the user at a location on the apparatus 10 and in an user-specific configuration determined by the user. Embodiments of the apparatus 10 further comprise one or more weights 20 being coupled to the apparatus 10 at one or more positions on the attachment portions 11*b*/13*b*. For example, in FIG. 1, one weight 20 may be positioned on the forearm section 16 of the right arm of the user, one weight 20 on the upper arm section of the right arm of the user, one weight 20 near the fastener 12 in the middle of the apparatus 10 near the user's chest, and one weight 20 near the bottom of the portion 11 on the left side of the apparatus 10 near the user's abdomen. In FIGS. 2 and 3, the weights 20 may be positioned on the apparatus 10 in other exemplary user-determined configurations. Having this structural configuration, the apparatus 10 may have as many weights 20 attached thereto as desired by the user in as many unique user-determined positions on the apparatus 10 as desired by the user. Therefore, the exercise apparatus 10, including the number, position, and weight of the weights 20 attached thereto, is customizable by the user.

Figure 4A:
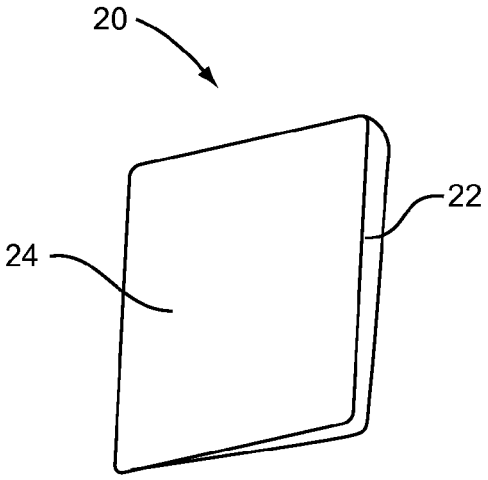
FIG. 4*a* is a rear view of a component of the exercise apparatus in accordance with the present disclosure.
Figure 4B:
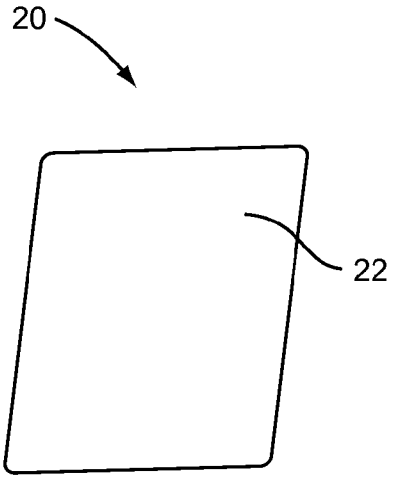
FIG. 4*b* is a front view of the component of the exercise apparatus of FIG. 4*a* in accordance with the present disclosure.

As shown in FIGS. 4*a* and 4*b*, embodiments of the apparatus 10 may further comprise each weight 20 including at least a covering 22 and a coupling surface 24. The covering 22 may be configured to cover and protect the inner components of the weight 20, which will be described in detail below with reference to FIGS. 5-10. The covering 22 may be customized to the configuration, size, and shape of the weight 20. Embodiments of the covering 22 may further comprise the apparatus 10 being configured such that the covering 22 may completely surround the inner components of the weight 20. Alternatively, embodiments of the covering 22 may further comprise the apparatus 10 being configured such that the covering 22 may surround a portion of the inner components of the weight 20, whereas the coupling surface 24 may surround the remaining portion of the weight 20. The covering 22 may be comprised of a material that is thin, lightweight, and breathable. The covering 22 may also be configured to be flexible to move and adapt to the changing shape of the inner components of the weight 20, in response to the user moving in the apparatus 10, as will be described below.

Embodiments of the apparatus 10 may further comprise the coupling surface 24 being configured to be able to adhere to the of the apparatus 10, namely the coupling surface 24 may be configured to repeatedly and releasably couple to the attachment portions 11*b*/13*b* on the upper-body portion 11 and the lower-body portion 13, respectively. The coupling surface 24 is configured to allow the user to attach and detach the individual weights 20 from the apparatus 10, as desired. The coupling surface 24 is not only durable for repeat use, but is also strong enough to adequately adhere its accompanying weight 20 to the apparatus 10 as the user actively moves about wearing the apparatus 10. As the user moves, gravity acts on the weights 20 to attempt to pull them off the apparatus 10. However, the coupling surface 24 is sufficiently strong to keep the weights 20 attached to the apparatus 10 at the desired user-placed location.

Embodiments of the apparatus 10 may comprise the coupling surface 24 being a collection of hooks that function to "hook," or grip, the small loops on the exterior of the portions 11 and 13. Indeed, in one embodiment, the apparatus 10 and the coupling surface 24 function as corresponding parts of a hook-and-loop fastening mechanism, similar to the technology trademarked as Velcro®. Combining the effects of the relatively snug fit of the apparatus 10 on the user and the adhesive strength of the hook and loop fastening engagement between the coupling surface 24 and the apparatus 10, the weights 20 are positioned relatively firmly against the user's body. Such a snug configuration prevents the weights 20 from separating any significant distance from the user's body during activity by the user. Such a snug configuration also prevents the weights 20 from bouncing up and down relative to the user. Specifically, when the weights 20 are secured relatively snugly to the user's body, the weights 20 do not significantly shift relative to the user's movement. When the weights 20 are secured relatively snugly to the user's body, the user feels as though the weights 20 are part of the user's weight and not separate therefrom. This provides the illusion that the user is in fact not wearing any weights 20 at all.

The embodiments of the apparatus 10 and the configuration of the weights 20 with respect to the apparatus 10 are designed to reduce the relative movement of the weights 20 with respect to the user of the apparatus 10. For example, if a user were to place a weight on an article of clothing worn by the user, the weights may not be secured relatively snugly to the user's body. Gravity would then act to create a "moment" force. This moment force would be a result of gravity creating a rotational force on each weight due to the distance between the weight and the user's body. Indeed, when a distance is created between the weight and the user's body, the article of clothing to which the weight is attached functions to create a pivot, or fulcrum, about which the weight will tend to rotate.

In other words, as the article of clothing attempts to hold the weight in place, the distance between the weight and the user's body will allow the weight to rotate slightly about the axis created between the user and the weight on the clothing. This rotational movement would allow the weight to "bounce" up and down on the clothing relative to the user's own movements. Such forces can, and will be, sensed by the user and will provide discomfort to the user that is wearing the clothing having the weight thereon. Such discomfort could lead the user to discontinue wearing the weights on the clothing and even the article of clothing itself.

However, embodiments of the apparatus 10 in accordance with the present disclosure, are configured to secure, maintain, and otherwise hold, the weights 20 securely enough to the user's body that the rotational moment force that could act on the weights 20 is eliminated, or at least reduced to the point that it is negligible to the user of the apparatus 10. Accordingly, as stated above, the user of the apparatus 10 feels as though the weights 20 on the apparatus are indeed part of the user's own weight. This creates an illusion in the user's mind that the user is not wearing any additional weight at all, when in fact the user is carrying the weights 20. Such illusory effect provides the advantage of the apparatus 10 over conventional exercise devices. Indeed, the user may wear the apparatus 10, apply the weights 20, and move about doing the normal day-to-day activities that the user does and not feel as though the user is carrying additional weight when doing so. In this way, the user exercises without realizing that he/she is exercising.

Embodiments of the apparatus 10 further comprise the coupling surface 24 being coupled to the covering 22 by any means that allows the covering 22 and the weight 20 to remain attached to the coupling surface 24, as the coupling surface 24 remains attached to the apparatus 10. For example, the coupling surface 24 may be glued, coupled, stitched, or otherwise adhered, to the covering 22. As shown in the embodiment of FIGS. 4*a* and 4*b*, the coupling surface 24 may be stitched to the covering 22, which secures the coupling surface 24 to the covering 22. The covering 22 can also be glued to the inner components of the weight 20, or the covering 22 can be stitched to itself around the inner components of the weight 20. The covering 22 can be secured to, or about, the inner components in any way that allows the covering 22 to protect the inner components and yet allow the coupling surface 24 to attach securely to the covering 22. In alternative embodiments, the coupling surface 24 may be coupled directly to the inner components of the weight 20 without the covering 22.

The covering 22 may also be color-coded to indicate different sizes/masses of weights 20. One color may reflect a particular mass of the weight 20, whereas another color may reflect a different-sized mass of another weight 20. Also, the weights 20 may be configured in different shapes to designate different corresponding masses of the weights 20. Because of the possible different shapes and sizes of the weights 20, the coverings 22 may thus be shaped to accommodate the different sizes and shapes of the weights 20.

In addition to weights 20, the apparatus 10 may further comprise pockets (not shown) that can be repeatedly and releasably coupled to the apparatus by a coupling surface 24. The pockets may be placed at any location on the apparatus 10, in much the same way that the weights 20 may be placed and adhered to the apparatus 10 at any location where the attachment sections 11*b*/13*b* are positioned, and the pockets may serve to hold a user's personal items, such as keys, money, mp3 devices, or the like.

As shown in FIG. 5-10, embodiments of the apparatus 10 further comprise the weight 20 including inner components, namely a flexible substrate 26 and weighted parts 28. The flexible substrate 26 may be comprised of a material that is flexible enough to flex as the weighted parts 28 move, yet firm enough to provide a base to which the weighted parts 28 can be adhered. The substrate 26 may additionally be configured to be lightweight and breathable. The weighted parts 28 may be comprised of a material that is dense so as to have a large mass in a relatively small area. The weighted parts 28 can be comprised of a metal material, such as steel, but may also be comprised of any other material that has a relatively large density, similar to the density of metals. The weighted parts 28 may be coupled, adhered, or otherwise joined, to the substrate by adhesive means, such as for example, stitching, glue, sticky tape, or other similar means of adhesion.

Figure 5:
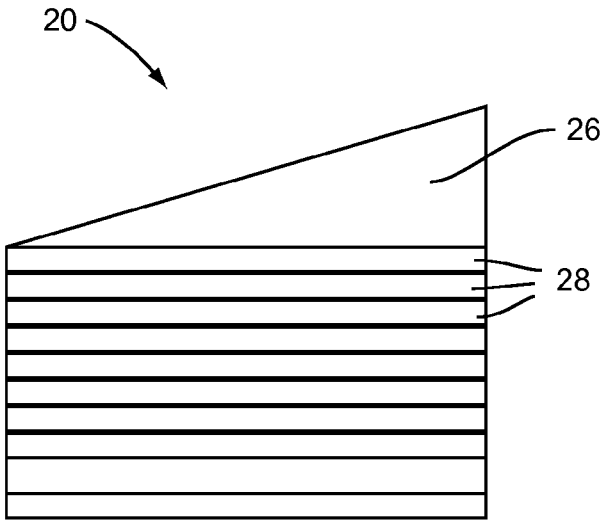
FIG. 5 is a top view of a component of the exercise apparatus in accordance with the present disclosure.
Figure 6:
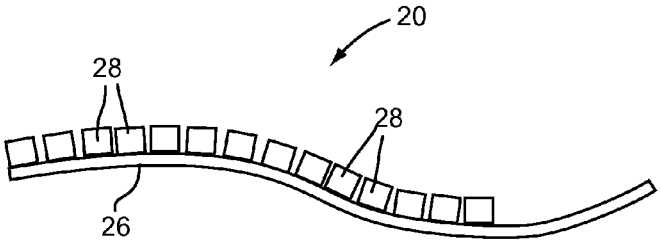
FIG. 6 is a side view of a component of the exercise apparatus in accordance with the present disclosure.

Embodiments of the apparatus 10 may further comprise the weighted parts 28 being configured on the substrate 26, in a side-by-side fashion as shown in the exemplary arrangement of FIG. 5, so that as the user moves within the apparatus 10, the movement of the user may displace individual weighted parts 28 of each weight 20. Thus, the above-described configuration of the weighted parts 28 on the substrate 26 allows the weighted parts 28 to move with respect to one another as the user moves but yet prohibits the weighted parts 28 from moving beyond the flexible confines of the substrate 26. Such a configuration permits the weighted parts 28 of the weights 20 and the substrate 26 to bend and flex with the movement of the user, as shown in FIG. 6. The rod-like configuration of the weighted parts 28 placed in the side-by-side orientation, as shown in FIGS. 5 and 6, maximizes the occupancy, and thus the weight, of the weights 20 in a relatively confined space. Yet, at the same time, this rod-like configuration allows flexibility between side-by-side weighted parts 28.

Figure 7:
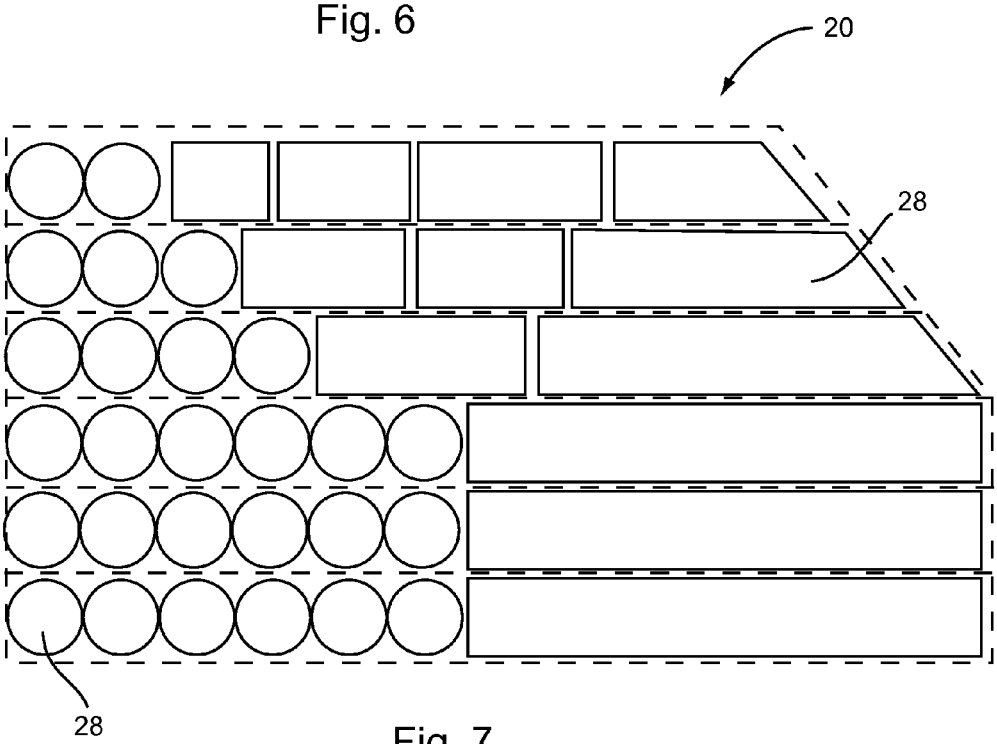
FIG. 7 is a top view of a component of the exercise apparatus in accordance with the present disclosure.

Embodiments of the apparatus 10 further comprise the weighted parts 28 of the weights 20 taking additional shapes to those of the rod-like configuration described above. For example, as depicted in FIG. 7, the weighted parts 28 may be configured in a variety of shapes placed side-by-side, row-by-row, column-by-column, such as rectangular shapes, square shapes, spherical shapes, and/or any combination of such. Indeed, the smaller the individual weighted part 28, the more freedom of movement and flexibility between weighted parts 28 as the user moves and flexes in the apparatus 10. Optimal shapes of the inner components of the weights 20 include those that do not leave significant negative space between individual weighted parts 28, yet allow flexibility and freedom of movement between neighboring weighted parts 28.

Figure 8:
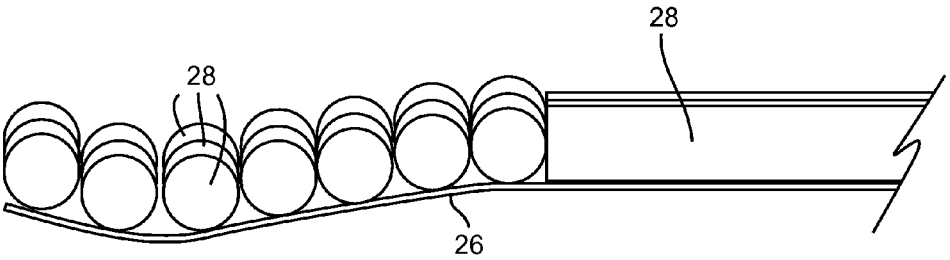
FIG. 8 is a side view of a component of the exercise apparatus of FIG. 7 in accordance with the present disclosure.

As depicted in FIG. 8, the configuration of rectangular and spherical weighted parts 28 provides additional freedom of movement and flexibility between weighted parts 28. Specifically, under the condition that sphere shapes or cube shapes are used as the weighted parts 28, these weighted parts 28 may bend and flex in more than one direction with respect to one another. In this way, the weighted parts 28 will move with respect to one another to shift and otherwise flex to the contour of the wearer, such that the weights 20 will not be overly rigid and "dig" into the user as the user wears the apparatus 10.

Figure 9:
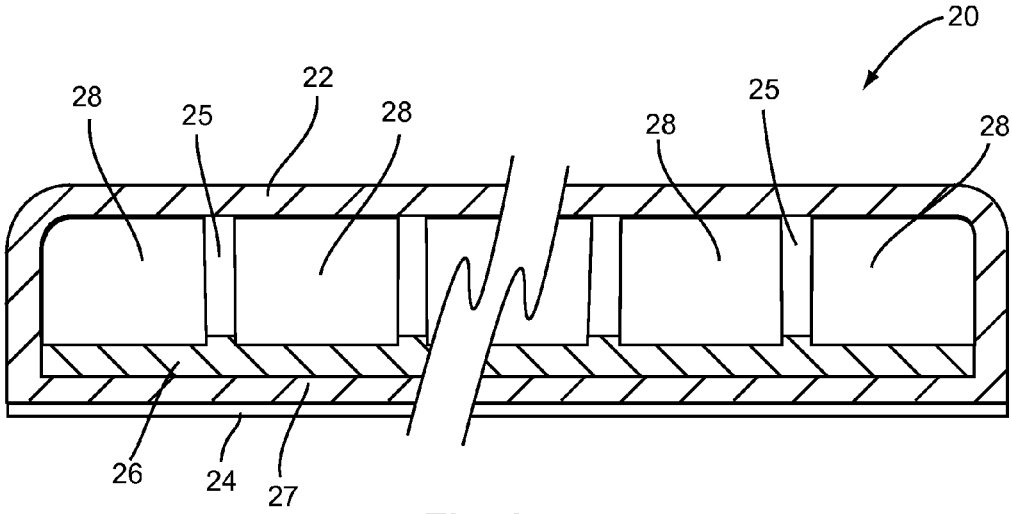
FIG. 9 is a cross-section view of a component of the exercise apparatus in accordance with the present disclosure.

With reference now to FIG. 9, embodiments of the apparatus 10 may further comprise the weighted parts 28 being oriented close together, but yet retaining a space 25, or void, therebetween, that allows the weighted parts 28 to better bend and flex independently from one another. The covering 22 may be wrapped over and cover the weighted parts 28, as well as wrap around the bottom edges of the flexible substrate 26 under the weighted parts 28, such that the covering 22 envelops the top surface of the weight 20 and bottom edge portions of the weight 20. A padded layer 27 may be positioned below the flexible substrate 26 and between ends of the covering 22 that are positioned under the flexible substrate 26. The coupling surface 24 may be coupled to the underside of the covering 22 and the padded layer 27, to secure the covering 22 and the weighted parts 28 in place. Thereafter, the coupling surface 24 may be used to adhere the weight 20 to the apparatus 10 at a position on the apparatus 10 chosen by the user. Moreover, the padded layer 27 may be placed either between the weighted parts 28 and the substrate 26 or underneath the substrate 26 between the substrate 26 and the covering 22. The padded layer 27 serves to provide an additional padded barrier between the rigidity of the weighted parts 28 and the user.

Figure 10:
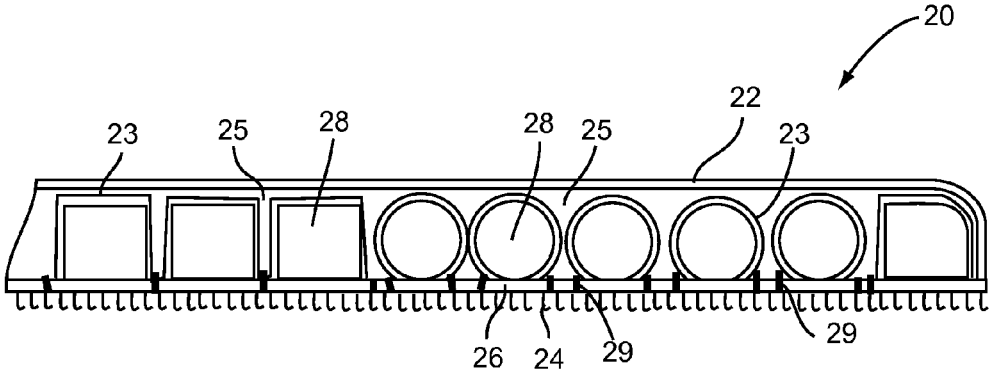
FIG. 10 is a cross-section view of a component of the exercise apparatus in accordance with the present disclosure.

With reference now to FIG. 10, embodiments of the apparatus 10 may further comprise the weighted parts 28 being oriented close together, retaining a space 25 therebetween, and being covered by an interior covering 23 that is coupled to the substrate between each individual weighted part 28, such that the individual weighted parts 28 are held securely in place with respect to the substrate, but yet are configured such that they are allowed to bend and flex with respect to one another and independently from one another. The covering 22 may also be wrapped over and cover each of the weighted parts 28, as well as wrap around the side edges of the weighted parts 28 to functionally couple to the flexible substrate 26 under the weighted parts 28, such that the covering 22 envelops the top surface of the weight 20 and edge portions of the weight 20.

As shown in FIGS. 1-3, 23 and 24, embodiments of the apparatus 10 may further comprise a port 30 and a complimentary elastic member 40. The port 30 may comprise a base 32 comprised of an interior base 32*a* and an exterior base 32*b* that sandwich therebetween the material of the apparatus 10. The interior base 32*a* and the exterior base 32*b* may be configured to be coupled or otherwise fastened together on either side of the material of the apparatus 10 by a fastener 35, such as a rivet, passed through corresponding coupling holes 34 in the bases 32*a* and 32*b*, thus functionally coupling the base 32 to the material of the apparatus 10 to fixedly secure and maintain the port 30 in place on the apparatus 10. The port 30 can be made of plastic, metal, or other rigid material that is capable of being coupled to the apparatus 10. Moreover, the port 30 can be coupled to the apparatus 10 by other fixing means other than rivets, such as by stitching, ironing, adhesive, or the like.

Embodiments of the apparatus 10 further comprise the port 30 having a socket opening 36 that is configured to receive and functionally engage a tip member 50 of the elastic member 40. The socket 36 may further comprise a tab 37 that is configured to flex in response to the tip member 50 being positioned within the socket 36. The tab 37 may be further configured with a lip 38 that is structured to functionally engage the tip member 50 and help prevent the tip member 50 from undesirably releasing from the socket 36. The tab 37 may be biased against the tip member 50, such that under the condition that the tip member 50 is positioned within the socket 36, the tab 37 pushes against the tip member 50 to hold the tip member 50 against the upper interior surfaces of the socket 36. The tip member 50 may have a ball-shape end 52, such that once engaged, the ball-shaped end 52 and the socket 36 function together as a ball-and-socket joint, in that the tip member 50 can rotate and pivot within the socket 36. Thereafter, to disengage the tip member 50 from the socket 36, the tip member 50 may be pushed downward against the biasing force of the tab 37 to flex the tab 37 downward to thereby release the tip member 50 from engagement with the socket 36.

In embodiments of the apparatus 10, the port 30 may comprise a bar, for example but not limited thereto, a metal bar, that can be coupled to the apparatus 10 at desired locations. The bar may be configured to permit another portion of the apparatus 10, for example, the elastic member 40, to be described below, to couple to the bar to thereby secure the elastic member 40 to the bar for the user to use.

Figure 23:
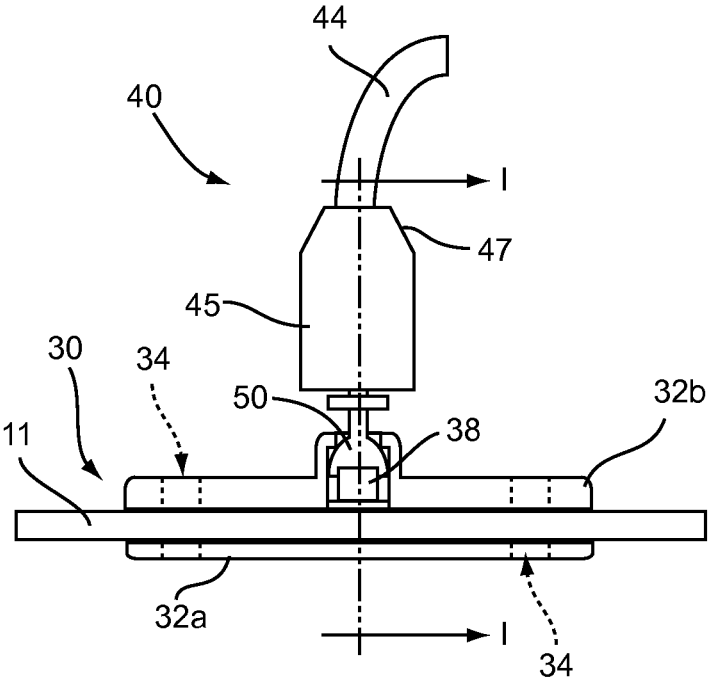
FIG. 23 is a side view of an embodiment of a component of the exercise apparatus in accordance with the present disclosure.
Figure 24:
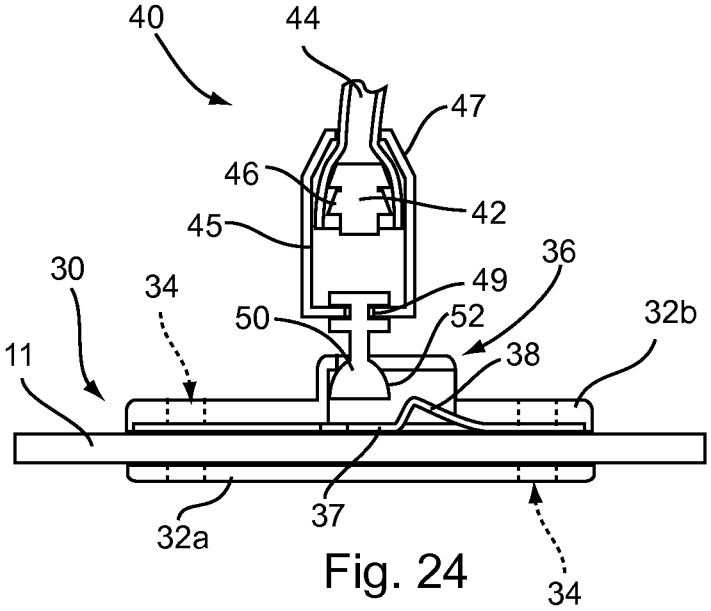
FIG. 24 is a side cross-sectional view of an embodiment of a component of the exercise apparatus in accordance with the present disclosure.

As shown in FIGS. 23 and 24, embodiments of the apparatus 10 may further comprise an elastic member 40. The elastic member 40 may comprise an elastic tubing 44, a coupling 42, and a cap 45. The elastic tubing 44 may be configured to be functionally coupled to the coupling 42. The elastic tubing 44 may be hollow such that the coupling 42 may be placed within the hollow interior of the tubing 44 and frictionally engage the tubing 44. The coupling 42 may further comprise ridges 46 that function to provide a friction surface against which the tubing 44 may engage. Under the condition that the coupling 42 is functionally engaged with the tubing 44, the combination of the coupling 42 and the tubing 44 may be placed within the cap 45. The cap 45 may be comprised of two corresponding halves that are configured to pivot with respect to one another between an open position and a closed position. In the open position, the cap 45 may be configured to receive therein the combination of the coupling 42 and the tubing 44. Thereafter, the corresponding halves of the cap 45 may be pivoted with respect to one another to the closed position such that the two halves close around the combination of the coupling 42 and the tubing 44 to retain the combination therein, but yet allowing a portion of the tubing 44 to exit therefrom. The cap 45 may further comprise a tapered end 47 proximate the tubing 44 that exits from the cap 45, the tapered end 47 being configured to functionally engage the ridges 46 of the coupling 42 with the tubing 44 therebetween. Such interaction prevents the tubing 44 from being pulled off the coupling 42 in the event that the tubing 44 is stretched, pulled, or otherwise activated. Only undue force should detach the tubing 44 from the coupling 42 once coupled in this fashion. Moreover, on the opposite side of the tapered portion 47, the cap 45 may further comprise an engagement opening 49 that may be configured to engage the tip member 50. In the open position, the cap 45 may not engage the tip member 50, but in the closed position, the engagement opening 49 of the cap 45 may engage a section of the tip member 50 to secure therein the tip member 50.

As depicted in FIGS. 1-3, 23 and 24, the elastic member 40 may repeatedly and releasably couple to any one of the individual ports 30. The ports 30 may be positioned on the apparatus 10 at positions determined during manufacturing. The ports 30 may be placed in the apparatus 10 where the joints of the user are expected to be. For example, as shown in FIGS. 1-3, the ports 30 may be located in the shoulder region, on both the front side of the apparatus 10 and the back side of the apparatus 10. On the back side of the apparatus 10, the ports 30 may be positioned just above the shoulder blades of the user, one port opening 30 above either shoulder blade. The ports 30 can be placed near the elbow joint, near the wrist joint, near the knee joint, and/or near the ankle joint. As shown in FIGS. 1-3, the ports 30 may be positioned in the apparatus 10 at the approximate joints of the user, as well as positioned on opposing sides of the joints, such that each joint may have a port 30 on either side thereof. Alternatively, the apparatus 10 may be configured to have user-installable ports 30, wherein rivet kits may be supplied with each apparatus 10, such that the user may determine where the location of the ports 30 may be on each individual apparatus 10 and use the rivet kits to thereafter fixedly attach the ports 30 to the apparatus 10, for a custom arrangement. By placing the ports 30 on the apparatus as described herein, the user may connect one or more elastic members 40 between ports 30.

In embodiments of the apparatus 10, the elastic member 40 may be configured to automatically couple or decouple from the port 30 upon touch by the user. Touching an automatic release member on the elastic member 40 may automatically and mechanically release the elastic member 40 from the port 30.

As depicted in FIG. 3, the elastic members 40 can be engaged between any two ports 30 chosen by the user of the apparatus 10. For example, but not limiting in any sense, an elastic member 40 may be coupled between one of the wrist ports 30 and one of the knee ports 30. Another elastic member 40 can be engaged between one of the ankle openings on either leg. Indeed, as can be seen from these exemplary configurations, one or more elastic members 40 can be secured between ports 30 on the apparatus 10, as chosen specifically by the user. Also, the user may choose to wear the apparatus 10 without engaging any of the ports 30, such that no elastic member 40 is utilized. Alternatively, the user may choose to engage every port 30, such that each port has engaged therebetween an elastic member 40. Because embodiments of the apparatus 10 are configured to utilize multiple elastic members 40, the elastic members 40 may be manufactured in different pre-determined lengths, such that the user may select the appropriate length of elastic member 40 to use between chosen ports 30. Also, the elastic tubing 44 used in the elastic members 40 may be manufactured to have different resistance, such that stretching one elastic member 40 between ports 30 is more difficult than stretching another elastic member 40 between the same ports 30.

Connecting elastic members 40 between ports 30 on the apparatus 10 allows the user to bend a joint of the user's body and encounter resistance in doing so. For example, with the exemplary configuration of FIG. 3, bending the user's arm at the elbow will encounter resistance from the elastic members 40 coupled between the ports 30 on the user's knee and the user's wrist, respectively. Also, for example, with the exemplary configuration of FIG. 3, moving the ankles apart from one another will encounter resistance from the elastic member 40 coupled between the ports 30 of the user's ankles, respectively. Accordingly, the user can pick and choose where to place the elastic members 40 on the various ports 30 on the apparatus 10 to increase resistance to movement of the user's body.

Embodiments of the apparatus 10 further comprise two or more users connecting elastic members 40 between ports 30 of their respective apparatuses 10, such that elastic members 40 run between one user's apparatus 10 to another user's apparatus 10. In this way, one user can serve as an anchor to the movement of the other user, and vice versa. Additionally, each user can serve as resistance to the other user as each of the user's moves within his/her respective apparatus 10. These movements may be in unison, arbitrary, choreographed, or in any other manner that allows the users to achieve resistance of movement.

Combining the customizable option of locating the weights 20 anywhere on the apparatus 10 according to the user's preference together with the customizable option of engaging the elastic members 40 between any two ports 30 on the apparatus 10, the apparatus 10 provides the user a completely customizable and user-defined exercise device.

Figure 11:
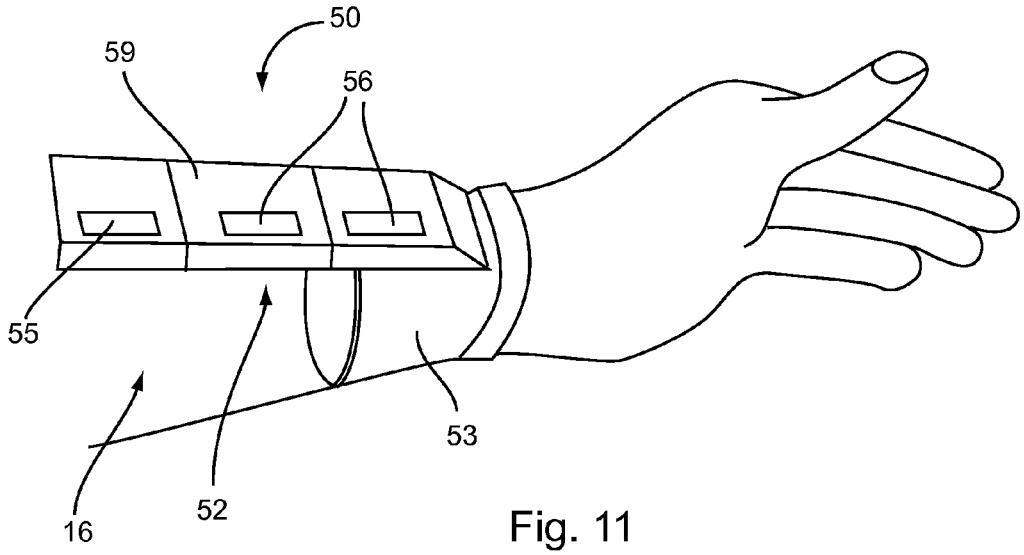
FIG. 11 is a side perspective view of a component of the exercise apparatus in accordance with the present disclosure.

As shown in FIG. 11, the apparatus 10 may further comprise a monitoring system 50 releasably coupled to the apparatus 10, wherein the monitoring system 50 further comprises a user interface 52 and means for monitoring a user's vital signs and other bodily performance indicators, such as, but not limited to, means for monitoring blood pressure, means for monitoring heart rate, and means for monitoring movements. For example, but not limited thereto, embodiments of the apparatus 10 may further comprise the removable forearm section 16 incorporating the user interface 52, wherein the user interface 52 displays the user's vitals, such as, but not limited to, blood pressure, heart rate, and/or number of movements. The monitoring system 50 may be powered by a battery, such that no external power source is needed to operate the monitoring system 50.

The means for monitoring blood pressure may include a blood pressure measuring cuff 53 that inflates over the user's wrist under the monitoring system 50. The cuff 53 may thereby measures the user's blood pressure and transmits the measured results to the monitoring system 50, wherein the monitoring system 50 displays the results on the user interface 52. Blood pressure monitoring cuffs and their related hardware and software are known in the art and are incorporated herein in their entirety.

The means for monitoring heart rate may include a heart rate monitor 57, such as, for example, a chest strap integral with the apparatus 10, the chest strap configured to rest over the user's heart and to measure the heart beat rate of the user while wearing the apparatus. The chest strap may also be a separate piece from the apparatus 10. Nonetheless, the chest strap may be configured to transmit measured results to the monitoring system 50, wherein the monitoring system 50 displays the results on the user interface 52. The means for monitoring heart rate may also include a heart rate monitor 57, such as, for example, a finger sensor 55 integral with the monitoring system 50, wherein the user may touch a finger to the sensor 55 allowing the sensor 55 to measure the user's heart rate. The measured results of the finger sensor 55 are then transmitted to the monitoring system 50, wherein the monitoring system 50 displays the results on the user interface 52. Heart rate monitoring chest straps and finger sensors and their related hardware and software are known in the art and are incorporated herein in their entirety.

The means for monitoring the user's movement may include a pedometer 59 that measures the user's individual movements. The measured results of the pedometer 59 are then transmitted to the monitoring system 50, wherein the monitoring system 50 displays the results on the user interface 52. Pedometers and their related hardware and software are known in the art and are incorporated herein in their entirety.

Providing the apparatus 10, and in certain embodiments, the forearm section 16 with various vital sign measuring tools that measure the performance and status of the user, i.e., the user's body status and vital signs, while wearing the apparatus 10 benefits the user by displaying to the user whether or not the particular exercise routine being engaged in by the user is effective or not as appropriate exercise. Further, as discussed above, the forearm section 16 can be removed from the apparatus 10 when not desired by the user. Accordingly, the forearm section 16 that incorporates the monitoring system 50 may also be placed on or removed from the apparatus 10 as desired by the user. In this way, the monitoring system attached to the forearm section 16 may be sold separately from the apparatus 10 and coupled to the apparatus 10 thereafter. The user interface 52 may also comprise one or more digital displays 56, having LCD, LED, OLED, and/or touch-screen technology incorporated therein, to display the user's measured body status and vital signs. The user interface 52 may also comprise a holographic display, displaying the user's measured body status and vital signs in 3-D. As such, the monitoring system 50 may comprise one or more processors, appropriate RAM, one or more memory units, and related hardware, as well as a software program that operates and controls the hardware of the monitoring system 50.

Figure 12:
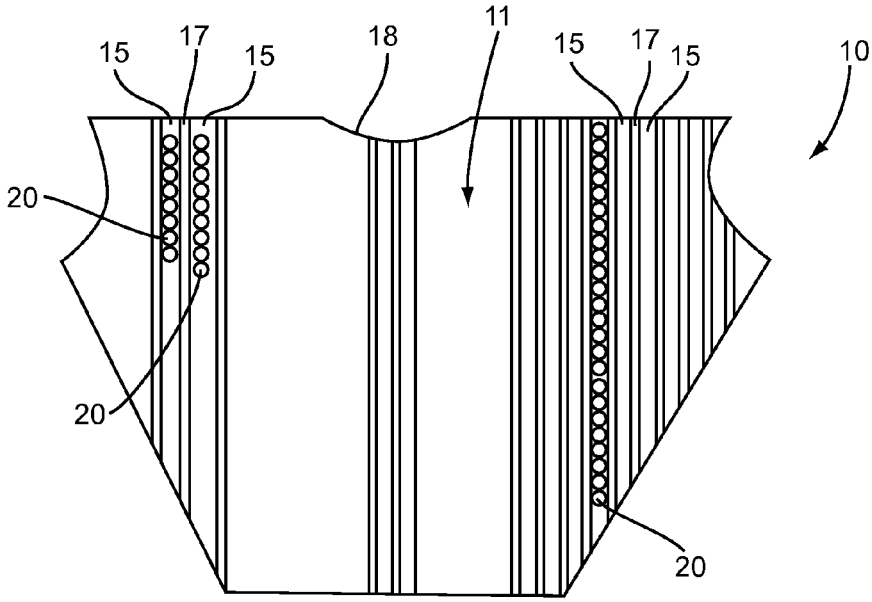
FIG. 12 is a front perspective view of a component of the exercise apparatus in accordance with the present disclosure.
Figure 13:
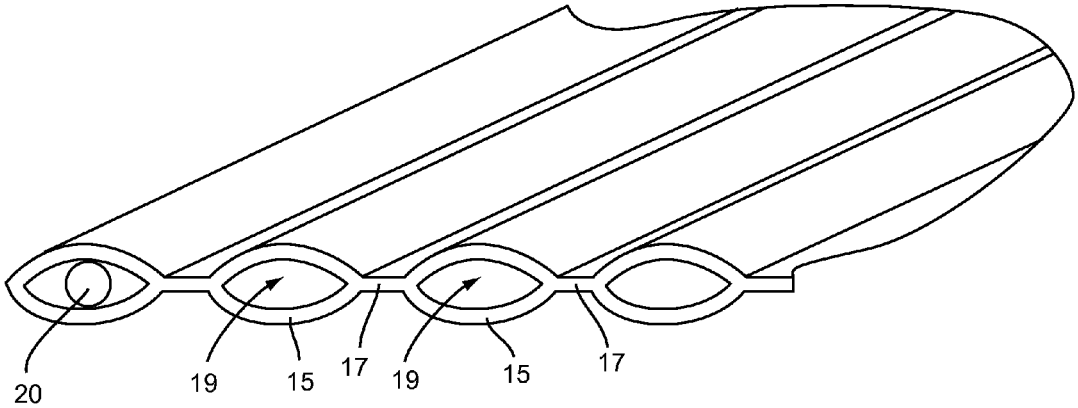
FIG. 13 is a perspective view of a component of the exercise apparatus in accordance with the present disclosure.
Figure 14:
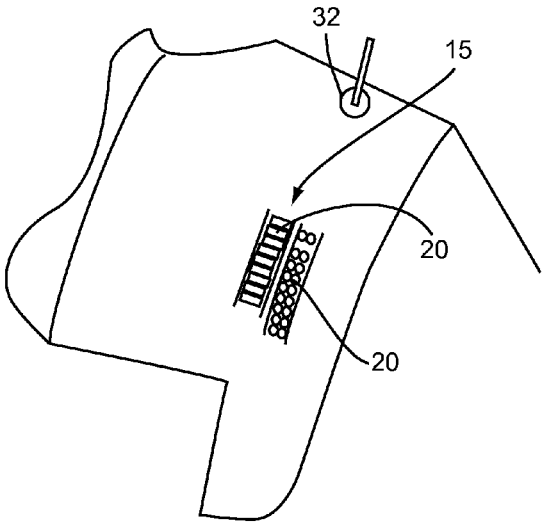
FIG. 14 is a perspective view of a component of the exercise apparatus in accordance with the present disclosure.

As shown in FIGS. 12-14, the apparatus 10 may further comprise tubes 15, or veins, stitched, or otherwise formed, within the material layers of the apparatus 10 that allow the elastic members 40, or other components, to run therethrough under the exterior layer of the apparatus 10 but above the user's skin. The tubes 15 may also be formed by press ironing alternating sections of the material together, such that hollow tubes 15 are created between the connected/stitched/ironed sections 17, as shown in FIGS. 12 and 13. The tubes 15 may have a generally vertical orientation and run generally parallel with the height of the user's body. However, the tubes 15 may be oriented in any direction desired during manufacturing to benefit the operation of the apparatus 10. For example, tubes 15 may be aligned vertically in portions of the apparatus 10, while the tubes 15 may be aligned horizontally in other portions of the apparatus 10, while yet the tubes 15 may be aligned diagonally in yet other portions of the apparatus 10.

Figure 16:
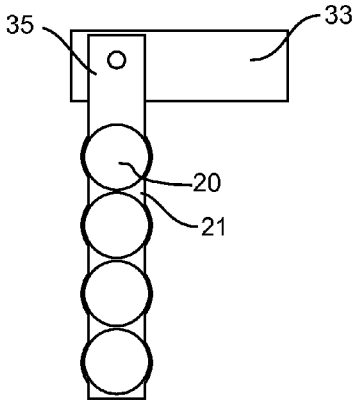
FIG. 16 is a front view of a component of the exercise apparatus in accordance with the present disclosure.

As shown in FIG. 13, the tubes 15 may define a hollow 19 and may have components, such as weights 20, inserted within the hollow 19. The weights 20 may be in the form of spheres, tubular pellets, or other similarly shaped forms that allow the weights 20 to be conveniently placed within the tubes 15. The weights 20 may be formed by aligning the spheres or pellets in a row and securing the weights 20 in this alignment by shrink wrapping, or otherwise retaining, the weights 20 in a constricting material 21, as depicted in FIG. 16. The row of weights 20 within the constricting material 21 may have attached thereto a coupling member 35 at an end of the row of weights 20. The coupling member 35 may be releasably coupled to an engagement port 33 positioned at locations on the apparatus 10 where the tubes 15 terminate. In this way, the rows of weights 20 can be releasably coupled by the coupling member 35 to the engagement port 33, such that the engagement port 33 secures the row of weights 20 to the apparatus 10, with the row of weights 20 positioned within the hollow 19 of the tubes 15.

Figure 15:
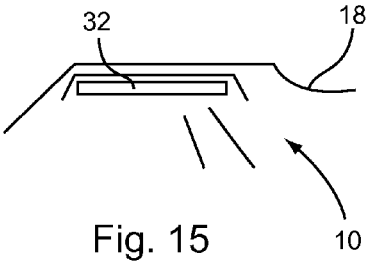
FIG. 15 is a front view of a component of the exercise apparatus in accordance with the present disclosure.

The engagement port 33 may comprise snaps, buttons, Velcro® attachments, or other fastening members that are configured to mate with and correspond to a corresponding fastening member that comprises the coupling member 35 on the row of weights 20. In this way, the coupling member 35 is configured to releasably couple to one of the engagement ports 33 positioned on the apparatus 10. As shown in FIG. 15, the engagement port 33 may be positioned in a shoulder region of the apparatus 10, such that the engagement port 33 can be configured to secure the rows of weights 20 within the tubes 15 that run down the chest portion of the apparatus 10.

Figure 17:
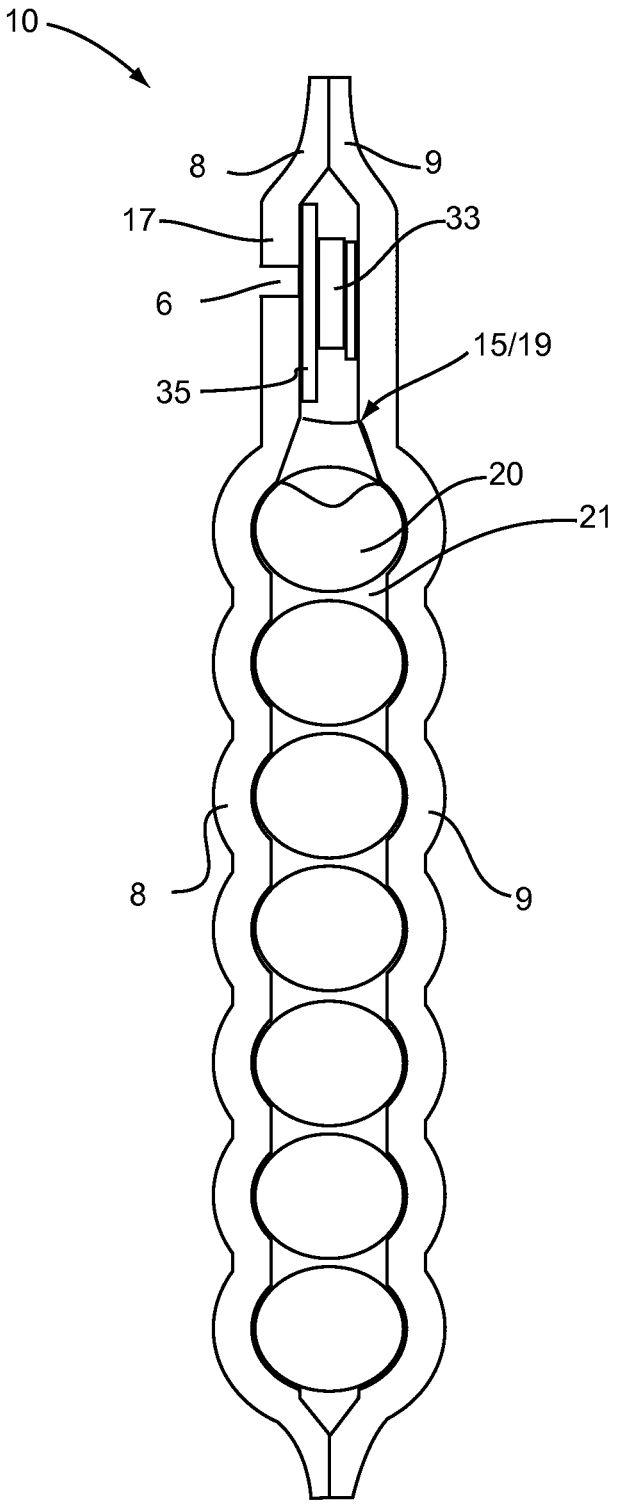
FIG. 17 is a side view of a component of the exercise apparatus in accordance with the present disclosure.
Figure 18:
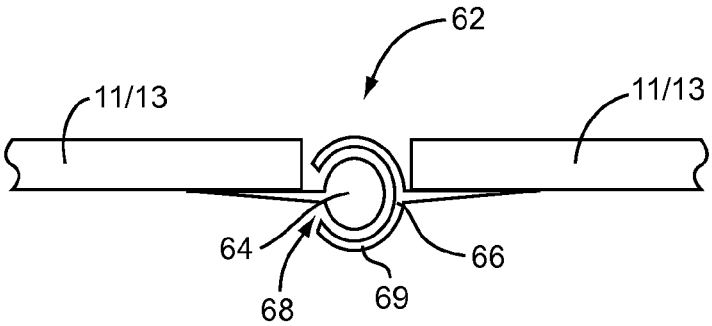
FIG. 18 is a cross-section view of an embodiment of a coupling component of the exercise apparatus in accordance with the present disclosure.

As depicted in FIG. 17, the rows of weights 20 may be positioned within the tube 15, and thus the hollow 19, created between a first layer 8 of material of the apparatus 10 and a second layer 9 of material of the apparatus 10. The first layer 8 may further comprise a flap 7 that defines an opening 6 in the first layer 8. The flap 7 may be lifted, or otherwise opened, to reveal thereunder the engagement port 33 positioned between the first and second layers 8 and 9. By opening the flap 7, the hollows 19 of each respective tube 15 are exposed, such that the rows of weights 20 may be inserted within the respective hollows 19, and the coupling member 35 on the end of each of the rows of weights 20 can be releasably coupled to the engagement port 33. In this way, the engagement port 33 secures the rows of weights 20 to the apparatus 10 within the tubes 15. Thereafter, the flap 7 may be lowered, or otherwise closed over the coupling member 35 and engagement port 33 to conceal each under the first layer 8. Thus, the user may add weight to the apparatus 10 in whatever tube 15 is available. Moreover, using the tubes 15, the user may conceal the weight 20 under the first layer 8 of the apparatus 10. Further, by securing the weights 20 within the tubes 15 under the first layer 8 of the apparatus 10, the weights 20 are held tightly against the user's body. The closer the weights 20 are to the user's body, the better performance of the apparatus 10, as described herein.

As shown in FIGS. 18-22, embodiments of the apparatus 10 may include a securing mechanism 62. The securing mechanism 62 may include a male component 64 and a corresponding female component 66. The male and female components 64 and 66 may be configured to releasably fasten together once the male component 64 is inserted into the female component 66. Specifically, the female component 66 may be configured to comprise a void 68 defined by an exterior shell 65. On the other hand, the male component 64 may be configured to have a shape that corresponds to the shape of the void 68 defined by the exterior shell 65. Also, the securing mechanism 62 may be configured to couple together in one direction, for example, but not limited thereto, a vertical direction, but may be resistant to decoupling in an opposing direction, for example, but not limited thereto, a horizontal direction. In this way, the securing mechanism 62 can be oriented to allow a user to easily couple the male and female components 64 and 66 together in one direction and have these same components 64 and 66 resist forces exerted on the components 64 and 66 in an opposing direction. For example, but without limitation, the securing mechanism 62 may be oriented on the apparatus 10, so as to allow the upper body portion 11 to fasten together at the front of a user. The user may insert, vertically, the male component 64 into the void 68 of the female component 66 and slide the male component 64 entirely through the void until the termination point of the male component 64 meets the termination of the female component 66. Thereafter, the securing mechanism 62 could be decoupled by sliding the male component 64 downward and out of the void 68 of the female component 66 until the male component 64 slides out of the female component 66. However, while coupled, the configuration of the male component 64 with respect to the female component 66 provides that the securing mechanism 62 is resistant to horizontal forces acting to pull apart the two sides of the upper body portion 11.

As shown in FIGS. 18-21, a cross-section of the securing mechanism 62 shows the shape of the male component 64 within the void 68 of the female component defined by the shell 65. Although the male component 64 can slide axially within the void 68, the male component 64 may be prohibited from sliding radially due to the physical configuration of the male component 64 and the female component 66.

Figure 19:
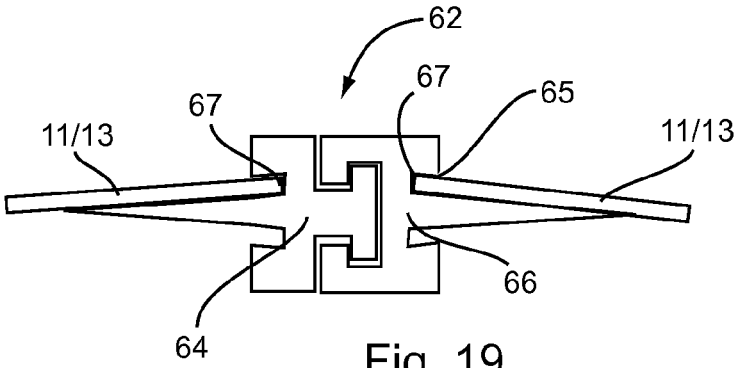
FIG. 19 is a cross-section view of an embodiment of a coupling component of the exercise apparatus in accordance with the present disclosure.
Figure 20:
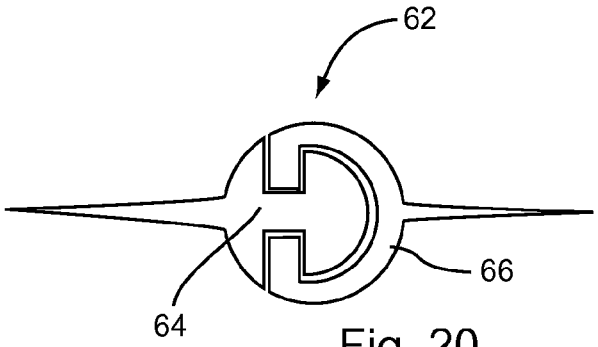
FIG. 20 is a cross-section view of an embodiment of a coupling component of the exercise apparatus in accordance with the present disclosure.
Figure 21:
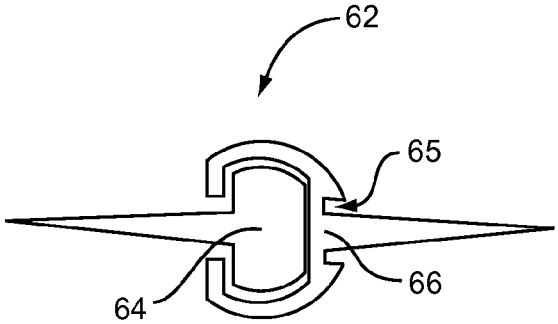
FIG. 21 is a cross-section view of an embodiment of a coupling component of the exercise apparatus in accordance with the present disclosure.

As depicted in FIG. 19, the material of the upper-body portion 11 or the lower-body portion 13 may be coupled to the male component 64 and the female component 66. The coupling of the material to the male and female components, 64 and 66 respectively, may be accomplished by press-ironing, gluing, stitching, or other adhesive coupling means. Further, an end portion 67 of the material may be inserted into a notch 65 in either of the male or female components 64 and 66 to hide the end portion 67 from view. In this manner, the seam between the material and the securing mechanism 62 may be covered and obscured from view.

Figure 22:
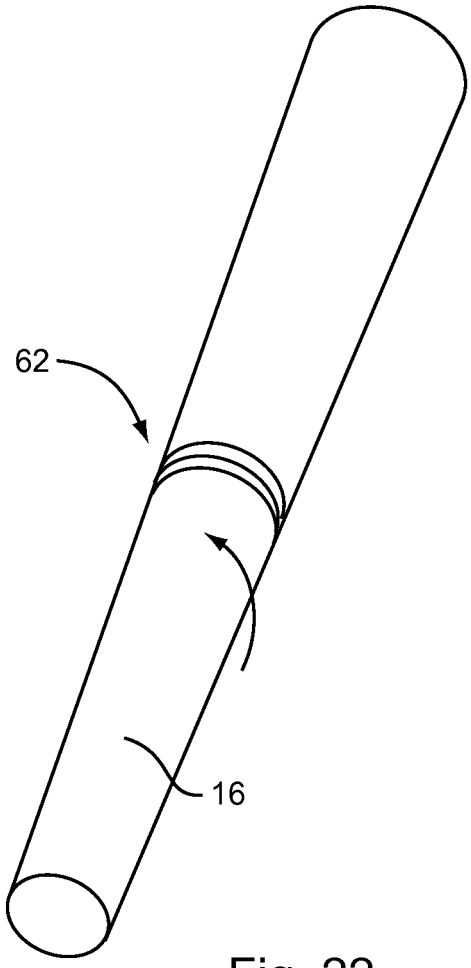
FIG. 22 is a front perspective view of an embodiment of a component of the exercise apparatus in accordance with the present disclosure.

Additionally, as shown in FIG. 22, the securing mechanism 62 may also be oriented horizontally, such that one of the male or female component 64 or 66 can be attached to the end of the upper arm of the upper body portion 11 of the apparatus 10 and the corresponding other of the male or female component 64 or 66 can be attached to the end of the forearm section 16. In this configuration, the components 64 and 66 can be initially engaged to one another, then the forearm section 16 can be twisted to further insert the male component 64 into the female component 66 until the components 64 and 66 are fully engaged. Thereafter, the forearm section 16 is resistant to orthogonal forces acting to pull the sleeve section off of the apparatus 10. The forearm section 16 can be removed by untwisting the components 64 and 66 off of one another to release the securing mechanism 62.

Embodiments of the apparatus 10 may further include portions of the apparatus 10 that comprise material that is breathable, such as mesh material or spandex material. For example, the sides of the apparatus 10 under the user's arms may be comprised of a mesh material or other moisture absorbing, breathable material that assists the user in staying dry and cool. Also, the inner leg regions of the apparatus 10 may also be comprised of mesh material or other moisture absorbing, breathable material that assists the user in staying dry and cool. Additional embodiments of the apparatus 10 may further include illuminating devices, such as headlights or LED lights, that may be releasably coupled to the apparatus 10 to provide light to the user during use of the apparatus in conditions with less than adequate lighting. These illuminating devices may be adhered to the apparatus 10 in much the same way that the weights 20 are adhered to the apparatus 10. Moreover, embodiments of the apparatus 10 may further include reflectors (not shown) that may be adhered to the apparatus 10 at positions on the apparatus 10 chosen by the user to best reflect light. In this way, the user may apply reflectors to keep the user safe during operation of the apparatus in high traffic areas or during conditions where visibility is low.

Embodiments of the apparatus 10 may further include a water reservoir (not depicted). The water reservoir may be contained within the layers 8 and 9 of the apparatus, such that a water reservoir may be placed within these layers 8 and 9 and filled with water to store the for consumption. Moreover, by securing the water reservoir between these layers 8 and 9, the water functions as a weight 20. Also, the water reservoir may be stored on the apparatus such that the user wearing the apparatus 10 supports the water reservoir on his/her back or his/her shoulders. The water reservoir may also contain a mouthpiece releasably coupled to the reservoir that can be accessed by the user of the apparatus to drink from, or drain, the water reservoir.

Embodiments of the apparatus 10 may include the apparatus being comprised of a breathable material that wicks moisture away from the body of the user to cool the user. The apparatus 10 may be comprised completely from this breathable material, or alternatively, portions of the apparatus 10 may be comprised of such breathable material. For example, the crotch area and underarm area of the apparatus 10 may be areas wherein the breathable material may be utilized. Also, the apparatus may be comprises of mesh material, which may be adjustable so that the apparatus 10 is easily adjustable for size. For example, some mesh areas of the apparatus 10 may be folded on one another and secured in this position to reduce the size of the apparatus 10 so that the apparatus 10 can be snuggly fitted to each individual user.

Embodiments of the apparatus 10 may further comprise a vertical support piece (not shown) that runs along, or near, the location of the user's spine in the apparatus. The vertical support piece will function to connect to fibers within the back portion of the upper-body portion 11 that connect the shoulder region of the apparatus to the vertical support piece, such that when the tightening mechanism (not shown) that is connected to the vertical support piece is tightened, the fibers tighten, or constrict, and pull on the material in the apparatus near the user's shoulders to position the user's back and shoulders into the proper alignment and posture.

Embodiments of the apparatus 10 may further comprise air chambers or ballasts integral with the apparatus 10, the ballasts being configured to receive pressurized air therein. The air chambers/ballasts may be configured to functionally couple to a source of pressurized air. Once the source of pressurized air is activated, the air may enter and fill the air chamber/ballasts. The air chamber/ballast may be configured to provide rigidity to the apparatus 10. For example, once an air chamber/ballast in the apparatus 10 near the user's arm is filled with air, the arm section of the apparatus 10 may be held in position by the air chamber/ballast and may resist the movement of the user. The air chamber/ballast may be configured within dual layers of the apparatus 10 or may be configured on the inside surface of the material of the apparatus 10. Further in this regard, the apparatus 10 may be configured with exterior pockets that are configured to receive therein a splint, the splint being a rigid piece of material that is pre-formed to a desired shape. The splint may be inserted into the exterior pocket of the apparatus 10 to further resist movement of the user. For example, an L-shaped splint may be inserted into a pocket of the apparatus 10, the pocket being positioned both above and below the user's elbow to prevent the user from thereafter moving the elbow. The splint would assist the ballast in restricting the movement of the user at a particular location on the apparatus 10. In this way, the user can utilize the apparatus 10 to immobilize a portion of the user's body while at the same time allowing the user to utilize the exercise features of the apparatus 10 over remaining portions of the user's body. In other words, the user may rehabilitate injured portions of the user's body while at the same time may exercise the healthy portions of the user's body. The apparatus 10 may further comprise a digital indicator that indicates to the user the status of the pressurized air chamber/ballast. The digital indicator may be an LCD screen, LED screen, or other LED indicator to indicate to the user the different levels of pressure within the air chamber/ballast. The LED may be color coordinated to the different pressure levels.

Embodiments of the apparatus 10 may further comprise acupressure knobs that may be utilized within the apparatus 10 to apply pressure to the user's body. The acupressure knobs may be in the form of pyramids, nipples, cones, or other similar shape that would provide pressure against the user's skin. The acupressure knobs may be positioned, as desired by the user, on the interior of the apparatus 10 or directly on the user's skin. The acupressure knobs may have adhesive coupled thereto for functionally holding the acupressure knob in place. In this way, the user may determine where he/she wishes to apply pressure to himself/herself. Once the acupressure knobs are positioned as determined by the user, the user may utilize the air chamber/ballast feature to apply pressure to the acupressure knob to force the acupressure knob down onto the user's skin. Alternatively, the user may simply use his/her hand, or other body appendage, to apply pressure to the apparatus 10 over the position of the acupressure knob, to thereby apply pressure to the acupressure knob to force the acupressure knob down onto the user's skin.

A method of use of the exercise apparatus will herein be disclosed. The user places the upper-body portion of the apparatus around the user and places the lower-body portion on the user's legs. The user fastens the upper-body portion to itself by way of a fastener. The user can then couple the upper-body portion to the lower-body portion to form a uniform suit. The user can then position weights on the apparatus at user-identified locations on the apparatus. In this way, the apparatus is customizable to the user's preferences. The user may also attach to the apparatus the elastic members at the various ports positioned on the apparatus. By securing one end of the elastic member to one port and the other end of the elastic member to another port, the user can stretch the elastic member between ports. The user can then move or bend his/her joints within the apparatus to engage the stretching resistance of the elastic member. Moreover, as the user moves, the weights move with the user, such that the user does not sense the added weight of the weights placed on the apparatus, but believes that the additional weights are in part of the user's own weight. Once the weights and/or the elastic members are placed, as chosen by the user, on the apparatus, the user can then go about the user's everyday activities as if no exercise is taking place whereas, in reality, the user's body is exercising to overcome and compensate for the added weight of the weights and the resistance of the elastic members. During the everyday activities, the user can remove or add, as desired, any weights and/or elastic members to increase or decrease, as the case may be, the weight or resistance desired on the apparatus. Thus, the user's use of the apparatus is completely customizable throughout the user's use of the apparatus. Then, once finished using the apparatus, the user may simply remove the upper- and lower-body portions and store the apparatus until the next use.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. An exercise apparatus, the apparatus comprising:

an upper-body portion comprised of stretch material and configured to be secured about a upper body of the user, the upper-body portion having a neck opening configured to receive a neck of the user therethrough and a pair of sleeves configured to receive therethrough respective upper limbs of the user;

a lower-body portion comprised of stretch material and configured to be secured about a lower body of the user, the lower-body portion being configured to receive legs of the user therethrough;

a weight, wherein the weight is configured to releasably couple directly to the stretch material of one of the upper-body portion and the lower-body portion as determined by the user;

a port configured to be positioned in the apparatus at or near a joint of the user, the port comprising an interior base portion, and an exterior base portion, the exterior base portion and the interior base portion being configured to couple to one another with the stretch material positioned therebetween;

an elastic member configured to functionally engage the port;

a socket configured to receive the elastic member;

a tab within the socket, the tab being biased toward the socket and configured to push against the elastic member under the condition that the socket engages the elastic member; and a lip on the tab, the lip being configured to retain the elastic member within the socket under the condition that the socket engages the elastic member.

2. An exercise apparatus, the apparatus comprising:

an upper-body portion comprised of stretch material and configured to be secured about a upper body of the user, the upper-body portion having a neck opening configured to receive a neck of the user therethrough and a pair of sleeves configured to receive therethrough respective upper limbs of the user;

a lower-body portion comprised of stretch material and configured to be secured about a lower body of the user, the lower-body portion being configured to receive legs of the user therethrough;

a weight, wherein the weight is configured to releasably couple directly to the stretch material of one of the upper-body portion and the lower-body portion as determined by the user;

a port configured to be positioned in the apparatus at or near a joint of the user;

an elastic member configured to functionally engage the port, the elastic member comprising:

an elastic band;

a coupling configured to functionally engage the elastic band;

a cap having a central bore and a first and second opening opposing one another, wherein the elastic band is configured to extend from the first opening and the central bore of the cap is configured to engage and retain therein the elastic band having the coupling engaged therewith; and a tip, the second opening of the cap configured to functionally engage the tip, wherein under the condition that the elastic member is functionally coupled to the port, the tip functionally engages the socket and is retained therein; and a socket configured to receive the elastic member.

3. The apparatus of claim 2, wherein the tip has a rounded shape and the tip and the socket function as a ball and socket joint.

4. The apparatus of claim 2, wherein the elastic member comprises opposing ends, one of the opposing ends being configured to functionally engage the port on the apparatus and the other of the opposing ends being configured to functionally engage another port at a different position on the apparatus.

* * * * *